US006142071A

United States Patent [19]

Fexer

[11] Patent Number: 6,142,071

[45] Date of Patent: Nov. 7, 2000

[54] CURB ADDRESS STENCIL KIT

[76] Inventor: Don P. Fexer, 1750 Northview Pl., Apt. 29, Eugene, Oreg. 97405

[21] Appl. No.: 09/467,601

[22] Filed: Dec. 20, 1999

Related U.S. Application Data

[60] Provisional application No. 60/113,187, Dec. 21, 1998.

[51] Int. Cl.[7] ..... B41F 15/02; B41L 13/02; B05C 17/08

[52] U.S. Cl. ..... 101/128; 101/114; 101/127; 101/127.1

[58] Field of Search ..... 101/114, 115, 101/121, 127, 127.1, 128, 128.1, 128.21, 129, 48, 112

[56] References Cited

U.S. PATENT DOCUMENTS

| | | | |
|---|---|---|---|
| 204,803 | 6/1878 | Dana | 101/128 |
| 1,781,258 | 11/1930 | Walker | 101/128 |
| 2,451,775 | 10/1948 | Roher | 101/128 |
| 2,547,674 | 4/1951 | Tobey | 101/127.1 |
| 3,194,153 | 7/1965 | Rogerson | 101/127 |
| 3,584,385 | 6/1971 | Booth | 101/128 |
| 4,563,948 | 1/1986 | Cafferty | 101/114 |
| 4,652,337 | 3/1987 | Picone et al. | 101/128.21 |
| 4,852,483 | 8/1989 | Bussard | 101/114 |
| 5,339,735 | 8/1994 | Corderman | 101/114 |
| 5,460,087 | 10/1995 | Ogorzalek | 101/128.21 |
| 5,556,686 | 9/1996 | O'Shea | 428/99 |

FOREIGN PATENT DOCUMENTS

| | | | |
|---|---|---|---|
| 9674 | of 1890 | United Kingdom | 101/128 |

*Primary Examiner*—John S. Hilten
*Assistant Examiner*—Leslie J. Grohusky

[57] ABSTRACT

A re-useable stencil kit made of a semi-rigid panel material for the application of painted address characters and a decorative painted background on a street curb. A base decorative background stencil (10) having an elongated opening featuring a decorative shape (12, 28) at the right and left sides of the opening. Address characters formed in separate, character stencil cards (18) featuring one address character (20) each, are arranged within the cavity of the opening in the background stencil along with blank spacer cards (22, 24, 26) to form the desired address. The spacer cards fill in void space on either side of, and center the character stencil cards, simultaneously masking the painted background. The stencils and spacers fit closely together to prevent paint over spray and to provide accurate character alignment. In addition, the stencil pieces may feature keyed joints (30) to further enhance alignment, and the semi-rigid panel material may have an adhesive back (34, 36) surface with a peel-off backing to provide close contact to background surface (16).

16 Claims, 5 Drawing Sheets

CURB ADDRESS STENCIL KIT

CROSS REFERENCE TO RELATED APPLICATION

This application claims priority from U.S. Provisional Patent Application Ser. No. 60/113,187, Filed Dec. 21, 1998 of Don P. Fexer, Entitled: Curb Address Stencil Kit

FIELD OF INVENTION

This invention relates to street addresses, specifically to address numbers painted on a street curb through the use of a unique stencil kit.

BACKGROUND ART

Curb addresses have typically been applied by a door-to-door vendor who will paint the site address directly on a street curb adjacent the owner's residence (or business) for a fee. Usually numbers are applied by using individual stencils. These stencils are either generic non-specific number stencils or custom made stencils. Most vendors do not offer a choice of background design styles or number font styles for the address and the finished quality of workmanship may not be what the owner expects, for example: numbers can be applied with uneven alignment; the background can wrap over the curb top, or be tilted; the numbers can have various spacing; paint over-spray may be apparent; the address may not be located or positioned as the owner would prefer; and/or the address may not be finished in a timely manner. Also, the vendor may call at a time when the curb address does not need replacement, or when the owner doesn't have cash ready to pay the fee. On the other hand, the vendor may not call when the address does need replacement. Usually, there is no way to contact a vendor to request this service.

Home owners desiring to have their address painted on the street curb usually have to wait for a vendor's service to come to the neighborhood in order to have the job done. Many times there is no typical schedule to which the vendor adheres. Most home owners do not take the time to manually attempt to apply an address to a curb, or don't have the materials or "know how" to paint numbers in a suitable manner. While generic stencils of individual numbers are available for purchase, many people won't take the initiative to create the manual stencils needed to paint a background for the numbers, or to assemble the number stencils and masking required to produce a legible curb address. A professional sign painter could be hired to paint the address, but this is usually a costly alternative.

Because of these above mentioned points, many people with street curbs available, do not have an address on the curb at all. A home (or business) lacking an address on the curb may be difficult to identify. An address on the structure only, is sometimes difficult to see, especially at night.

What is needed is a curb stencil kit that will allow the simple application of a street address and decorative background on a curb of a home or business.

DRAWING FIGURES

In the drawings, closely related figures have the same number, but different alphabetic suffixes.

SUMMARY

The present invention provides a stencil kit featuring a base stencil which is used to stencil a decorative background design and also uniquely supports and aligns character stencil cards and spacer cards that allow a person to apply address characters over a contrasting background with an attractive design directly to a street curb or other surface for easy identification.

The present invention thus fills a need for a unique stencil product which will provide a simple method by which a home or business owner can apply an attractive, custom address image to a street curb or other surface. The stencil product typically is a one-time purchase, allowing multiple addresses to be created from one kit. Owners thus are able to apply or reapply, or change the address when it is needed. Other address characters can be applied as the home owner moves to a new location. There is no need to depend on a vendor for curb address needs. The invented stencil product also can feature multiple background designs, character font styles and masking pieces to customize an address. The stencil product thus will yield an attractive and high quality curb address. There is no need to hand paint numbers or characters, cut masks or use generic stencils. The invention thus provides a stencil product that is especially made for stenciling a street curb with painted characters aligned and centered over a painted decorative background, and which can be used on a variety of other surfaces as well.

Further advantages include providing a curb address stencil kit which features pieces that fit together snugly to prevent paint over-spray leaks, which is made from a material that provides a cohesive connection to the curb surface, which is lightweight and durable, which can be used to create almost any address, which will yield weatherproof professional results, which stands out and makes a home or business easy to find, which may be endorsed by emergency services such as the police department or fire department. Still further advantages will become apparent from a consideration of the ensuing description and drawings.

DETAILED DESCRIPTION OF THE INVENTION

Figure 1A:
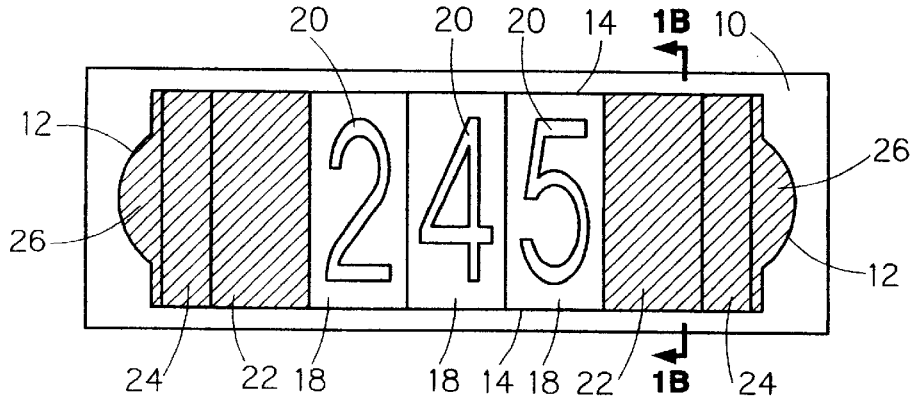
FIGS. 1A to 1E show front views (FIG. 1B a section view) of a decorative background stencil in accordance with the present invention, with various address character configurations of 3 to 6 digits with spacer card masks as needed.
Figure 1B:
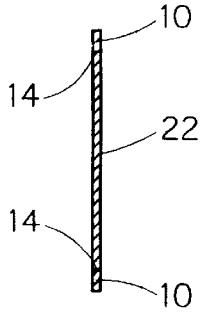
Figure 1C:
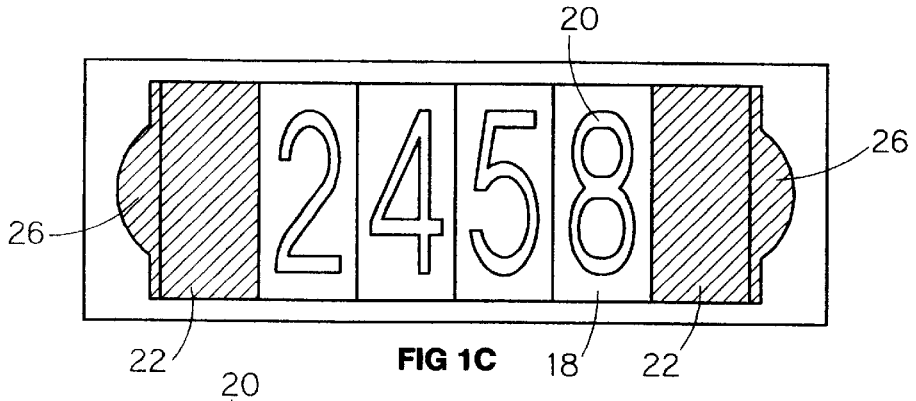
Figure 1D:
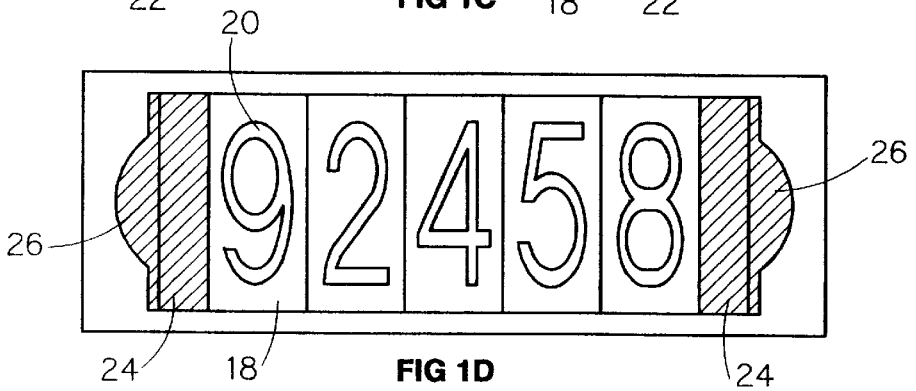
Figure 1E:
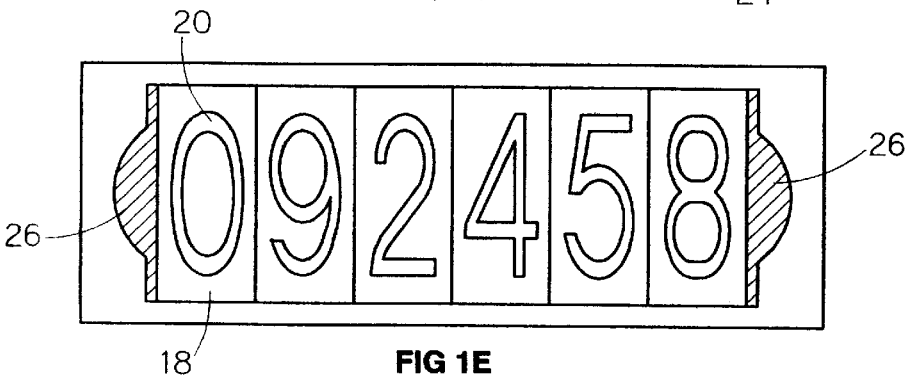
Figure 2:
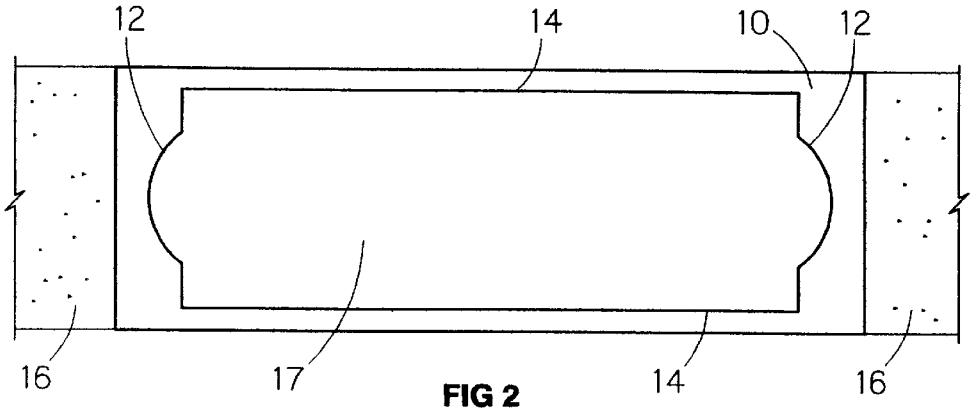
FIG. 2 shows a front view of an exemplary decorative background stencil on a curb with no character or spacer card masks inserted.

A typical embodiment of my address stencil kit invention is illustrated in FIG. 1A, FIG. 2 (front views), and FIG. 1B (section view). The base panel consists of a decorative background stercil 10. This stencil has an elongated cavity (delineated by track 14) opening formed to produce a "painted" decorative background design 17 on a (curb) background surface 16 (FIG. 2). The cavity in background stencil 10 acts as a support and track 14 (FIG. 1B) for address character stencil cards 18 and spacer cards 22, 24, 26 (FIG. 1A). Background stencil 10 features a decorative shape 12 at the right and left sides of the cavity area, the decorative shape 12 contours are mated to the contours of design shaped spacer cards 26. Decorative shape 12 can be formed in a variety of design shapes and sizes. FIGS. 1A, 1C, 1D, and 1E illustrates respectively how three, four, five, and six digit example address characters 20 could center in background stencil 10. The invented stencil kit could be configured to accommodate more than six characters. Background stencil 10 is typically 432 mm in length, 152 mm in height, and 5 mm in thickness, although finished dimensions may vary.

Figure 8:
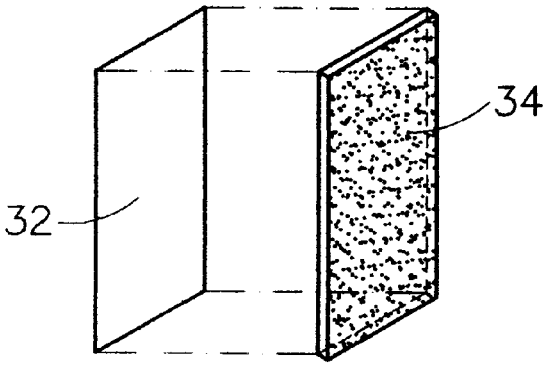
FIG. 8 shows an isometric view of a sample card made from a laminated foam material with an applied (peel-off backing) material over an adhesive surface on the backside.

In the preferred embodiment, (FIG. 5A) background stencil 10, character stencil cards 18, spacer cards 22, 24, and design shaped spacer cards 26 are all die-cut stencil panels, made of a laminated foam based material 34 (FIG. 8) with an adhesive surface on the back side, covered by an attached laminate (peel-off backing) material 32.

Figure 3A:
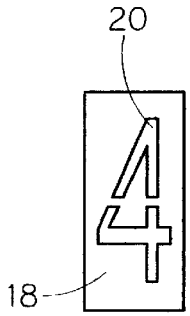
FIGS. 3A & 3B shows front and isometric views of exemplary address character stencil cards.
Figure 3B:
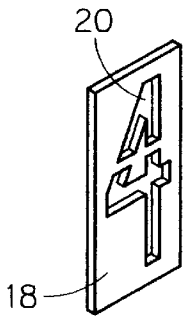
Figure 5A:
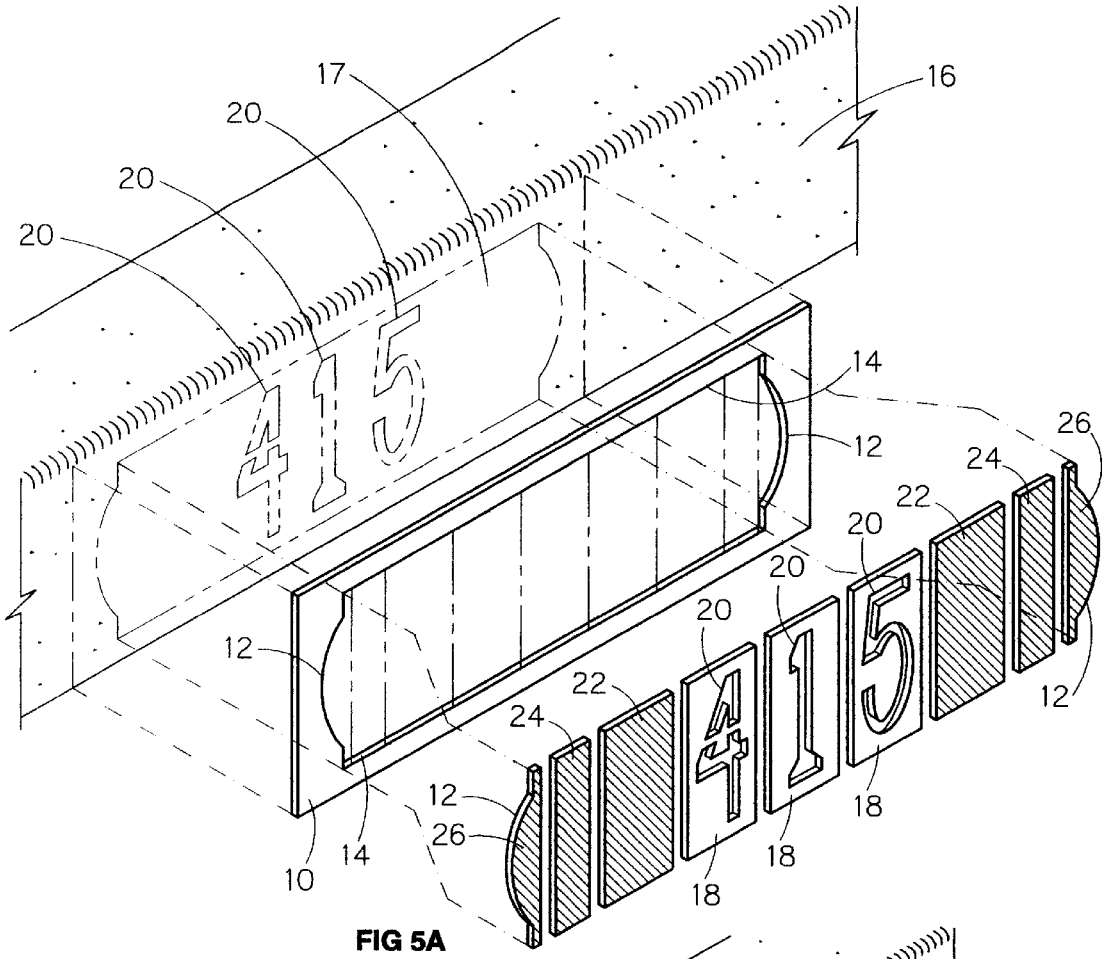
FIG. 5A is an exploded isometric view of curb address stencil components with a sample three digit address.
Figure 5B:
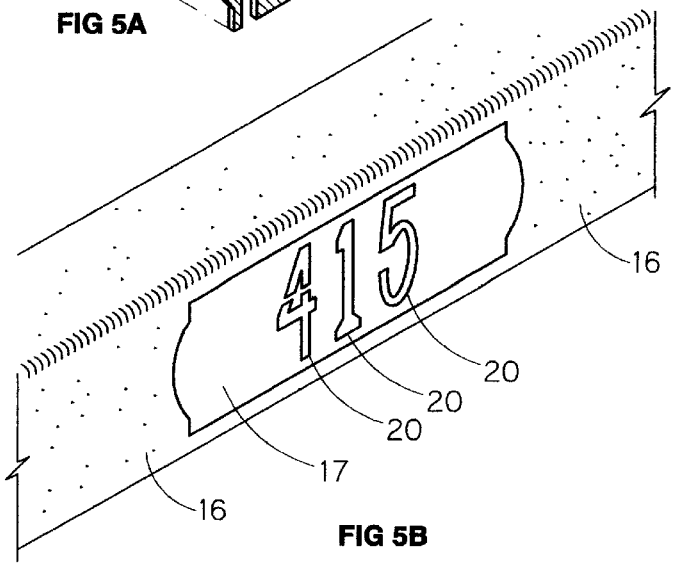
FIG. 5B shows an isometric view of an address and decorative background on a curb.

Character stencil cards 18 (FIGS. 3A & 3B) are part of a series of address character stencil cards used to produce "painted" characters 20 on a contrasting "painted" background design 17 (FIG. 2 & FIG. 5B). Characters 20 are precisely formed or cut out of character stencil cards 18, and the character stencil card 18 panel shapes are formed or cut out as well. The actual characters can include numbers, letters, or symbols. The characters hereby exemplified in the description and drawings are numbers, typically comprised of: 0, 1, 2, 3, 4, 5, 6, 7, 8, 9, one character 20 per card. Character stencil cards 18 fit snugly into the elongated cavity portion of the background stencil 10 (FIG. 1A or FIG. 5A).

Figure 4A:
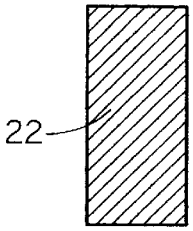
FIGS. 4A to 4F shows front and isometric views of different spacer card shapes and designs used in masking (shown with hatching).
Figure 4B:
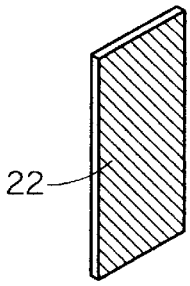
Figure 4C:
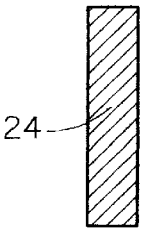
Figure 4D:
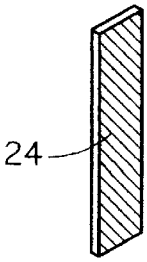

Spacer cards 22, 24, & 26 (FIGS. 4A to 4F) are masking cards (shown hatched) with no characters which are used to fill-in space on either side of character stencil cards 18 (FIGS. 1A, 1C, 1D, and 1E). They are provided to form replacements for character stencil cards 18. The invented stencil kit typically includes full width (equal to the width of the character stencil cards 18) spacer cards 22 (FIGS. 4A & 4B), and one-half width (one-half the width of the character stencil cards 18) spacer cards 24 (FIGS. 4C & 4D). Spacer cards 22 & 24 also fit snugly into the elongated cavity of background stencil 10 (FIG. 1A or FIG. 5A). Two design shaped spacer cards 26 (FIGS. 4E & 4F) are cut to match decorative shape 12 (FIG. 2) inside the left and right sides of background stencil 10. These design shaped spacer cards 26 fit into the space between character stencil cards 18 or spacer cards 22 or 24 and decorative shape 12 (FIG. 1A or FIG. 5A) at each side, (each end) which is formed in background stencil 10. Spacer cards will cover and mask "painted" background design 17.

An exploded view of a typical address and the stencil components thereof is shown in FIG. 5A. FIG. 5B shows an example of what the "finished address" would look like after applying a background design 17 and characters 20 to a curb or other background surface 16. Similar results will be achieved when a background design 17 and characters 20 are applied to other surfaces or materials.

Figure 4E:
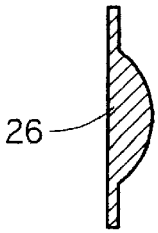
Figure 4F:
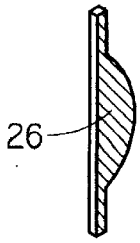
Figure 6:
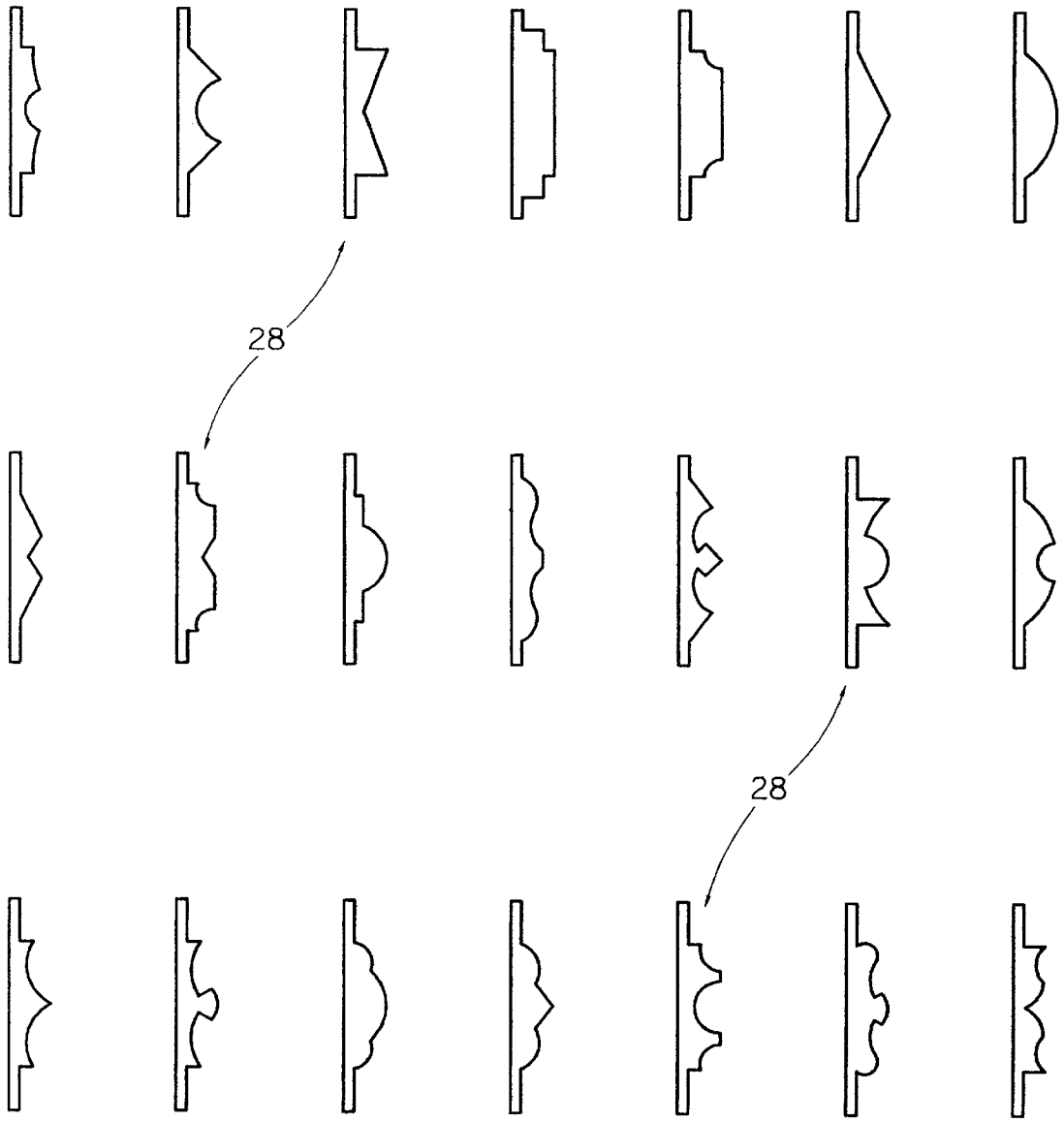
FIG. 6 shows a variety of design shaped spacer cards demonstrating some alternative shapes and styles.
Figure 7:
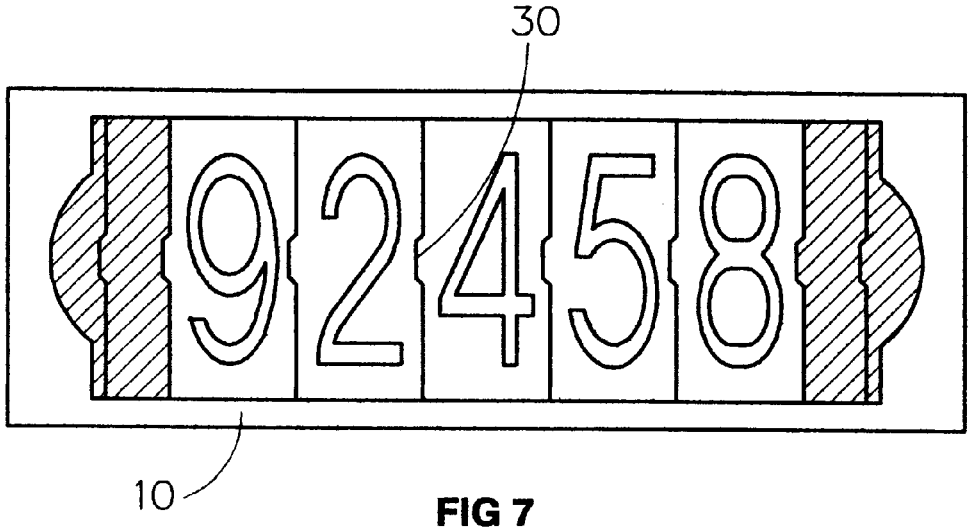
FIG. 7 shows a front view of address character stencil cards and spacer cards with keyed joints placed within a decorative background stencil.
Figure 9:
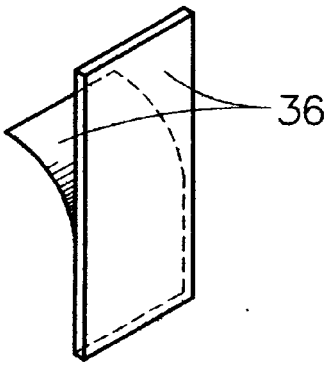
FIG. 9 shows an isometric view of a sample card made of a semi-rigid material with an adhesive sheet material applied to the backside.

Additional embodiments are shown in FIGS. 6, 7, & 9. FIG. 6 illustrates just some of many other shapes 28 (typical) that can be used for design shaped spacer cards 26 (FIGS. 4E & 4F). FIG. 7 shows character stencil cards 18 and spacer cards 22, 24, & 26 with keyed joints 30. FIG. 9 shows a stencil consisting of a semi-rigid material base 36 with an adhesive sheet product applied to the back side.

Operation

In order to apply an address to a curb (or other surface) one first removes the peel-off backing (preferred embodiment) from background stencil 10 (FIG. 2) and positions it in the desired location, placing it in flush and secure contact with background surface 16 (curb). The receiving background surface 16 should be clean and dry. Paint (usually reflective white) is then applied to the exposed background surface 16 within the cavity portion of background stencil 10. This finished "painted" background design 17 will become the "painted" base for the address characters 20 (FIG. 5A). The background stencil 10 is not removed at this point, but left in place. Paint is usually applied in spray form, although other applications of a medium is possible as well.

After the paint has dried sufficiently, one removes the peel-off backing (preferred embodiment) from the character stencil cards 18 (FIG. 5A), these are placed within the cavity portion of background stencil 10 one at a time, to form the desired address. The character stencil cards 18 are then aligned contiguous to one another by sliding them as required to a centered position in the background stencil 10, which is also acting as a track 14 and support for the character stencil cards 18.

The remaining exposed "painted" background design 17 on each side of the character stencil cards 18 is then covered (masked) by inserting the appropriate spacer cards 22, and/or 24, and design shaped spacer cards 26 (FIG. 5A). One removes the peel-off backing (preferred embodiment) and inserts equal spacer cards on each side of the character stencil cards 18 automatically centering the address within the background stencil 10. Design shaped spacer cards 26 correspond to, and fit into decorative shape 12 formed in background stencil 10. The depicted background stencil 10 can accommodate one to six characters to form an address. Several copies of each character stencil card 18 will be provided to allow the creation of any address[1]. Refer to FIGS. 1A, 1C, 1D, and 1E to see respective examples of how three, four, five, and six character addresses center in the background stencil 10 through use of the above mentioned spacer cards. One or two character addresses would be set-up in a similar fashion using the appropriate spacer cards for centering and masking. The hatched (shaded) areas indicate spacer cards.

[1] Typical addresses in the U.S.A. do not exceed six digits according to the United States Postal Service.

After the character stencil cards 18 and the spacer cards 22, and/or 24, and design shaped spacer cards 26 (FIG. 5A) are in place, with flush contact to "painted" background design 17, paint, contrasting the background color, (usually black) is evenly applied to the address character 20 openings in the character stencil cards 18, thus forming the "painted" address characters over the "painted" background design 17. All stencils are then carefully removed from the background surface 16, revealing the finished address characters centered on a decorative background (FIG. 5B).

Conclusion, Ramifications, and Scope

Accordingly, the reader will see that the invented curb address stencil kit can be used by anyone wishing to apply an address to a street curb or other surface. In addition to its easy setup and application, the user will find that this kit can be used over and over again in the creation of many different addresses. Anytime the user changes address locations or needs to replace an old or worn address, the kit can simply be reconfigured as necessary with the desired address characters. This is simple and convenient because several copies of each character are provided on character cards, and a variety of spacer cards are provided with each kit allowing the creation of any typical address.

Furthermore, the user will find that one can create an address with professional results. This is because stencil pieces fit together accurately and fit close to the background surface, leaving no gaps for paint leakage or over spray. The finished address will yield an attractive custom design on a street curb that will stand out to emergency personnel, as well as others seeking an address, making a home or business easy to find.

Although the description above contains many specificities, these should not be construed as limiting the scope of the invention but as merely providing illustrations of some of the depicted embodiments of this invention. For example, the stencils and spacer pieces can be made of many different materials such as: cardboard or paper product, plastic material, foam material, rubber product, vinyl product, metal product, resin product, fiber product, product including wax, composite material, etc. Base material(s) can also be laminated or have a laminate material attached. An adhesive or sticky-back material would also provide sure contact between the stencil products and the surface for application.

Stencils and spacer cards (or pieces) can be created through different methods of manufacturing such as by: molding, stamping, forming, punching, casting, computer cutting, etc. Stencils and spacer pieces can also be made in a variety of designs, shapes, and sizes and can be fit together in ways other than shown in FIG. 5A to accomplish the same task.

Other possibilities to aid in a stenciled address application are as follows: The background stencil can have fold-out, extended, or otherwise provided side and top panels to provide additional masking for the surrounding surface; stencil and spacer pieces can be color coded, printed with guidelines, or otherwise identified to aid in assembly of kit pieces; a variety of stencil kit pieces can be provided as to allow the user to fit pieces together for the creation of custom designs; the stencil kit can be supplied with different character font styles for the. character cards; the stencil kit can be made to accommodate more than six digits or characters for longer addresses; the stencil kit can be made in different sizes to accommodate various curb sizes or other special surfaces for application; and/or the stencil kit can be made to align characters in different formats, such as in angled address characters or vertical-reading address characters.

Thus the scope of the invention should be determined by the appended claims and their legal equivalents, rather than by just the examples given.

I claim:

1. A stencil kit for use in applying paint to a street curb to form an address and a background, the stencil kit having stencil kit pieces, the stencil kit pieces comprising:

(a) a base background stencil of sufficient size to fit on a street curb, the background stencil including an elongated cavity configured to receive paint whereby a painted background is created, wherein said elongated cavity in said background stencil has interior edges that form a track and has left and right sides having predetermined decorative shapes to allow creation of the painted background with respective decorative shapes;

(b) a plurality of character stencil cards capable of being supported and aligned in said track in said elongated cavity and configured to receive paint whereby painted characters are created over the painted background;

(c) a plurality of spacer cards capable of being supported and aligned in said track of said elongated cavity and used to cover and mask portions of the painted background; said plurality of spacer cards being comprised of units matching the width of said character stencil cards and units matching one-half the width of said character stencil cards and are further used for centering said character stencil cards and are arranged at either side of said character stencil cards within said elongated cavity in said background stencil, wherein said plurality of spacer cards include a plurality of design shaped spacer cards of said one-half width, made with a shape conforming to, and mated to the contours of said predetermined decorative shapes at said left and right sides of said elongated cavity; and whereby a person can apply an address and an underlying background on a street curb or other surface.

2. The stencil kit of claim 1 wherein each stencil kit piece is formed of a semi-rigid material and shares a common thickness thereby creating a panel of one unit of said semi-rigid material after said stencil kit pieces are assembled together.

3. The stencil kit of claim 2 wherein said semi-rigid material is made of a laminated foam composite.

4. The stencil kit of claim 2 wherein said semi-rigid material is made of a paper/cardboard product.

5. The stencil kit of claim 2 wherein said semi-rigid material is made of a plastic composite material.

6. The stencil kit of claim 2, wherein each stencil kit piece further includes an adhesive substance applied to one surface of said semi-rigid material.

7. The stencil kit of claim 6, wherein each stencil kit piece further includes a protective peel-off backing over said adhesive substance.

8. The stencil kit of claim 1 wherein said character stencil cards and said spacer cards closely fit together with each other and to said background stencil and conform to a predetermined shape of said interior edges when assembled within said elongated cavity.

9. The stencil kit of claim 1 wherein each of said plurality of character stencil cards is a stencil with a single character.

10. The stencil kit of claim 9, further including a plurality of each character stencil card with said single character.

11. The stencil kit of claim 9 wherein said single character refers to a number.

12. The stencil kit of claim 11 wherein each number has a value which falls in the range from 0 to 9.

13. The stencil kit of claim 9 wherein said single character refers to a letter.

14. The stencil kit of claim 13 wherein each letter has a value which falls in the range in value from A to Z.

15. The stencil kit of claim 9 wherein said single character refers to a symbol.

16. The stencil kit of claim 1, further including keyed joints at right and left sides of said plurality of spacer cards and said plurality of character cards to allow for enhanced alignment contiguous to, and between each card.

* * * * *